US009775416B2

(12) United States Patent
Harris

(10) Patent No.: US 9,775,416 B2
(45) Date of Patent: Oct. 3, 2017

(54) UMBRELLA DEVICE

(71) Applicant: Janice Harris, Navarre, FL (US)

(72) Inventor: Janice Harris, Navarre, FL (US)

( * ) Notice: Subject to any disclaimer, the term of this patent is extended or adjusted under 35 U.S.C. 154(b) by 0 days.

(21) Appl. No.: 15/282,181

(22) Filed: Sep. 30, 2016

(65) Prior Publication Data

US 2017/0105495 A1 Apr. 20, 2017

Related U.S. Application Data

(60) Provisional application No. 62/241,224, filed on Oct. 14, 2015.

(51) Int. Cl.

| | |
|---|---|
| ***A45B 11/00*** | (2006.01) |
| ***A45B 25/02*** | (2006.01) |
| ***A45B 19/04*** | (2006.01) |
| ***A45B 25/24*** | (2006.01) |
| ***A45B 25/08*** | (2006.01) |
| ***A45B 25/16*** | (2006.01) |

(52) U.S. Cl.

CPC ..... *A45B 11/00* (2013.01); *A45B 19/04* (2013.01); *A45B 25/02* (2013.01); *A45B 25/08* (2013.01); *A45B 25/16* (2013.01); *A45B 25/24* (2013.01)

(58) Field of Classification Search

CPC ... A45B 23/00; A45B 11/00; A45B 2025/003; A45B 25/02; A45B 25/08; A45B 25/22; A45B 2023/0025; B60P 3/341; B60P 3/343; B60P 3/34; B60J 11/025; B60J 5/04

USPC ..... 135/16, 98, 31, 33.2–33.41, 33.5, 88.07; 296/97.1, 97.7–97.9, 161, 163, 183

See application file for complete search history.

(56) References Cited

U.S. PATENT DOCUMENTS

| | | | | | |
|---|---|---|---|---|---|
| 1,998,291 | A | * | 4/1935 | Sherman | A45B 19/00 135/25.2 |
| 2,319,118 | A | * | 5/1943 | Farkas | A45B 15/00 135/31 |
| 4,061,154 | A | * | 12/1977 | Cox | A45B 25/18 135/33.41 |
| 4,979,535 | A | * | 12/1990 | Sadowski | A45B 25/18 135/33.41 |
| 5,150,728 | A | | 9/1992 | Stark | |
| 5,287,871 | A | * | 2/1994 | Trice | B60J 11/00 135/16 |
| 5,385,161 | A | | 1/1995 | Loker et al. | |
| 5,468,087 | A | * | 11/1995 | Tung | A45B 25/18 135/33.5 |
| 5,529,368 | A | | 6/1996 | Cui et al. | |

(Continued)

*Primary Examiner* — Winnie Yip

(74) *Attorney, Agent, or Firm* — Global Intellectual Property Agency, LLC; Jordan Sworen

(57) ABSTRACT

An umbrella for removably securing to a surface, such as a vehicle. The umbrella includes a shaft having a handle on a first end and a canopy on an opposing second end. One or more ribs are secured to the canopy in order to support the canopy in an open configuration. Each rib includes one or more weights in order to stabilize the canopy when secured to a surface. One or more magnets are secured to a lower end of each rib in order to removably secure the umbrella to a magnetic surface for hands-free use. An upper end of each rib is hingedly secured to the shaft. The ribs are operably connected to an actuatable button in the handle so as to extend the ribs outward from the shaft in order to expand the canopy into the open configuration.

8 Claims, 4 Drawing Sheets

(56) References Cited

U.S. PATENT DOCUMENTS

| | | | | |
|---|---|---|---|---|
| 5,816,310 | A * | 10/1998 | Wu | B60J 11/06 160/370.21 |
| 6,568,737 | B1 * | 5/2003 | Li | B60J 11/00 160/370.21 |
| 6,959,715 | B2 * | 11/2005 | Siegel | A45B 11/00 135/16 |
| 7,806,131 | B1 * | 10/2010 | Seiler | A45B 15/00 135/33.2 |
| 7,967,274 | B1 | 6/2011 | Stallings, Jr. et al. | |
| 8,104,491 | B2 * | 1/2012 | Li | A45B 23/00 135/16 |
| 8,240,323 | B2 * | 8/2012 | Lee | A45B 11/00 135/20.1 |
| 8,567,423 | B1 * | 10/2013 | Combs, Jr. | E04H 15/32 135/120.3 |
| 2002/0139403 | A1 * | 10/2002 | Shi | A45B 11/00 135/16 |
| 2005/0247333 | A1 * | 11/2005 | Nipke | A45B 3/04 135/24 |
| 2006/0219278 | A1 * | 10/2006 | Lohman | A45B 11/00 135/16 |
| 2013/0256355 | A1 | 10/2013 | Gatto-Weising | |

* cited by examiner

UMBRELLA DEVICE

CROSS REFERENCE TO RELATED APPLICATION

This application claims the benefit of U.S. Provisional Application No. 62/241,224 filed on Oct. 14, 2015. The above identified patent application is herein incorporated by reference in its entirety to provide continuity of disclosure.

BACKGROUND OF THE INVENTION

The present invention relates to umbrellas. More specifically, the present invention provides an umbrella that removably secures to a magnetic surface, such as a roof of a vehicle.

When it rains many people use umbrellas in order to shield themselves from becoming soaked when traveling to and from their vehicle. In order to use an umbrella, an individual must hold the umbrella with at least one hand. However, it is difficult to perform necessary tasks, such as buckling and unbuckling children and loading and unloading groceries and other items from a vehicle, with the use of only one hand.

As a solution, some people attempt to balance the umbrella between an open vehicle door and the vehicle roof, but this is not sturdy or reliable and the umbrella can easily fall and cause injury to the individual due to pointed ends of the umbrella. Therefore, there exists a need for a device that can removably attach to a vehicle so an individual may use the umbrella in a hands-free manner.

Devices have been disclosed in the known art that relate to umbrellas. These devices generally relate to umbrellas having a fastener on a canopy thereof that adheres to surfaces for supporting the umbrella in an upright position. However, these devices fail to provide an umbrella having a plurality of ribs that terminate with a magnetic fastener. In this way, the canopy is disposed above the fastener so as to prevent a surface from obstructing the placement of the canopy. Further, these devices fail to provide ribs with weighted elements therein for adding stability to the umbrella during harsh weather conditions.

In light of the devices disclosed in the prior art, it is submitted that the present invention substantially diverges in design elements from the prior art and consequently it is clear that there is a need in the art for an improvement to existing umbrella devices. In this regard the instant invention substantially fulfills these needs.

SUMMARY OF THE INVENTION

In view of the foregoing disadvantages inherent in the known types of umbrella devices now present in the prior art, the present invention provides a new umbrella device wherein the same can be utilized for providing convenience for the user when removably securing an umbrella to a vehicle in order for use in a hands-free manner.

It is therefore an object of the present invention to provide a new and improved umbrella device that has all of the advantages of the prior art and none of the disadvantages. The umbrella includes a shaft having a handle on a first end and a canopy on an opposing second end. One or more ribs are secured to the canopy in order to support the canopy in an open configuration to prevent rain, sun, debris or other elements from contacting a user. Each rib includes one or more weights in order to stabilize the canopy. One or more magnets are secured to a lower end of each rib in order to removably secure the umbrella to a magnetic surface for hands-free use. An upper end of each rib is hingedly secured to the shaft. The ribs are operably connected to an actuatable button in the handle so as to extend the ribs outward from the shaft in order to expand the canopy into the open configuration.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
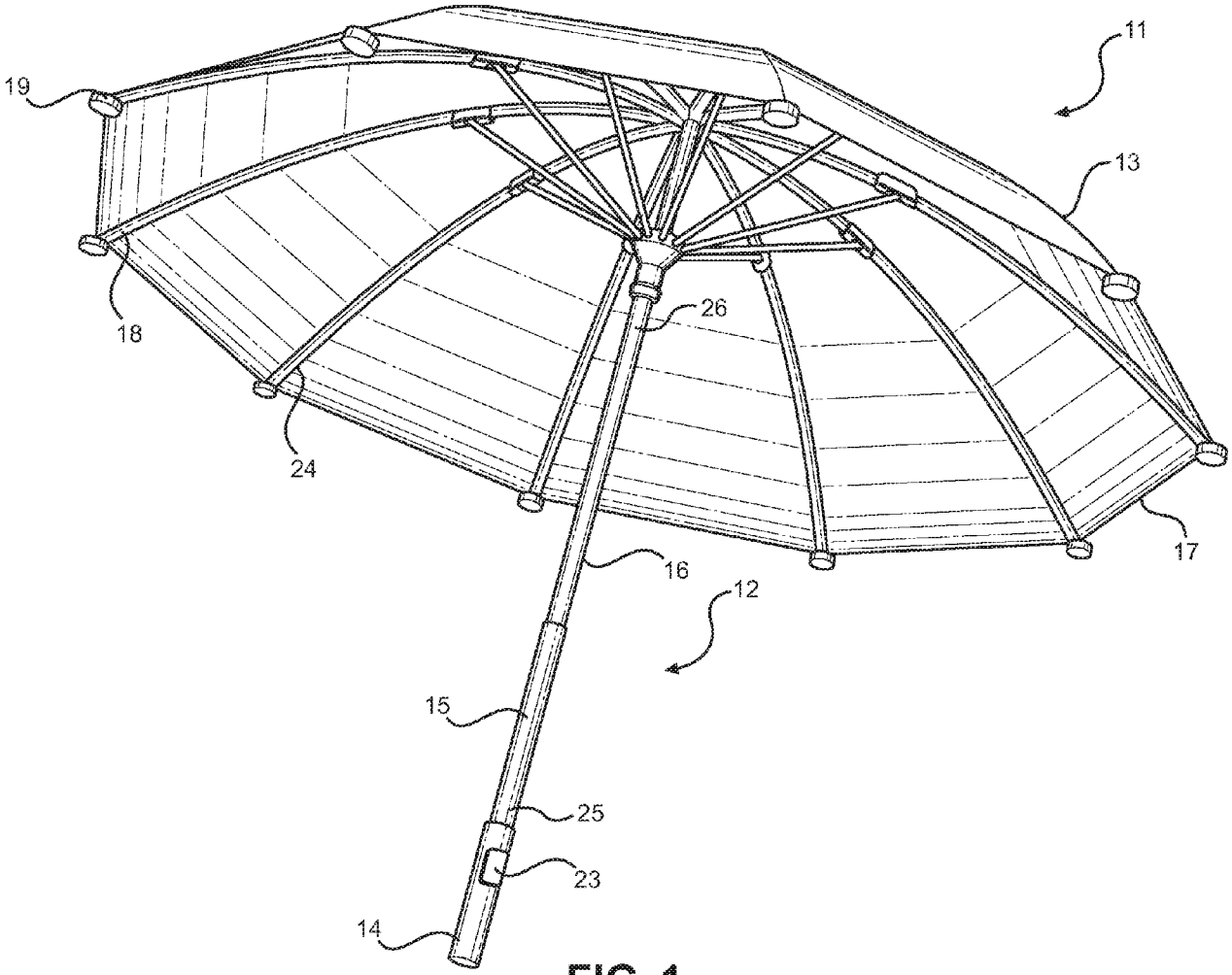
FIG. 1 shows a perspective view of an embodiment of the umbrella device.

Reference is made herein to the attached drawings. Like reference numerals are used throughout the drawings to depict like or similar elements of the umbrella device. For the purposes of presenting a brief and clear description of the present invention, the preferred embodiment will be discussed as used for removably securing an umbrella to a vehicle in order for use in a hands-free manner. The figures are intended for representative purposes only and should not be considered to be limiting in any respect.

Figure 2:
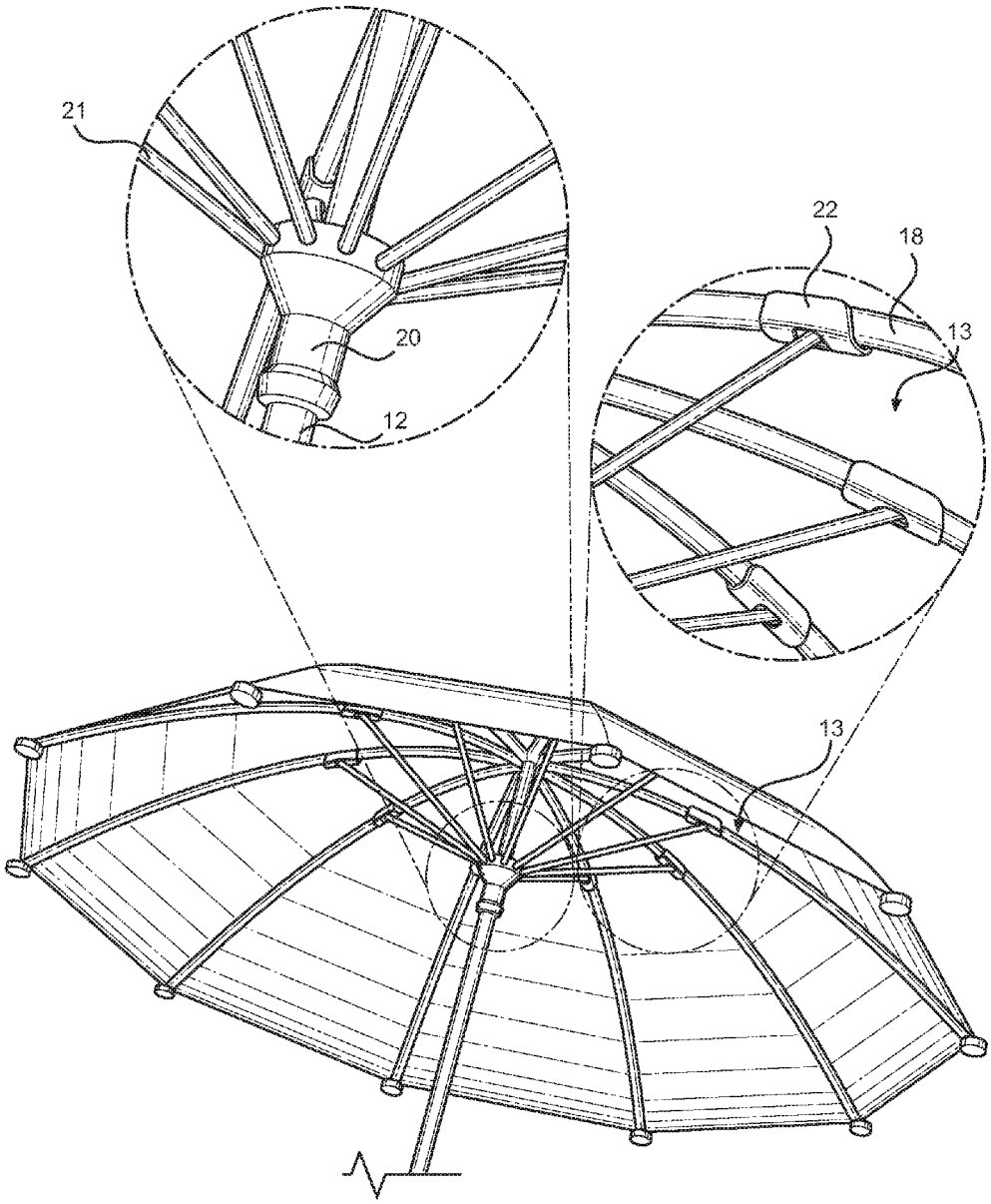
FIG. 2 shows a close-up view of the upper end of the umbrella device.

Referring now to FIGS. 1 and 2, there is shown a perspective view of an embodiment of the umbrella device and a close-up view of the upper end of the umbrella device, respectively. The umbrella device 11 includes a shaft 12 having a first end and an opposing second end, wherein the first end includes a handle 14 for allowing a user to grasp the umbrella device 11. The second end includes a canopy 13 adapted to shield a user disposed therebeneath from rain, sun, and the like. In the illustrated embodiment, the shaft 12 comprises a first rod 15 and a second rod 16 telescopically connected to one another. However, in alternate embodiments, the shaft 12 is composed of a single rod. In other embodiments, the shaft 12 is composed of more than two rods telescopically connected to one another.

In the illustrated embodiment, the canopy 13 is composed of a flexible material that repels water therefrom, such as plastic or nylon. In the illustrated embodiment, the canopy 13 comprises a dome shape, however, in alternate embodiments the canopy 13 comprises any suitable shape. The canopy 13 is configured to move between an open configuration and a collapsed configuration, wherein in an open configuration a lower end 17 of the canopy 13 is extended away from the shaft 12 and in the collapsed configuration the lower end 17 of the canopy 13 retracts toward the shaft 12.

The umbrella device 11 comprises a plurality of ribs 18 secured to the canopy 13 in order to move the canopy 13 between configurations and support the canopy 13 in an open configuration so as to prevent rain, sun, debris or other elements from contacting a user disposed therebeneath. In the illustrated embodiment, each rib 18 extends radially between an upper end of the canopy 13 and the lower end 17 thereof. The ribs 18 are spaced at fixed intervals to the lower surface of the canopy and secured to the canopy by any suitable fastener, such as stitching or adhesive. An upper end of each rib 18 is hingedly secured to the second end 26 of the shaft 12.

In the illustrated embodiment, a runner 20 is disposed around the shaft 12 in order to open and collapse the canopy 13. The runner 20 comprises an opening disposed in the center thereof, wherein the opening is configured to receive the shaft 12 therethrough and allows the runner 20 to slide therealong. The umbrella device 11 further comprises one or more stretchers 21 each having a first end connected to the runner 20 and a second end slidably connected to a rib 18. Each stretcher 21 serves as a brace for the canopy 13 when in an open configuration. The stretcher 21 further serves to collapse the canopy 13 by moving the runner 20 towards the first end 25 of the shaft 12. In alternate embodiments, an actuator is operably connected to the runner 20 in order to automatically expand the canopy 13 to the open configuration.

In some embodiments, the umbrella device 11 further comprises a spring lock (not shown) disposed on the shaft 12 configured to allow the runner 20 to remain thereabove, which allows the canopy 13 to remain in an open configuration. The spring lock protrudes outwards from the shaft 13 so as to allow the runner 20 to rest on the upper end thereof. In an open configuration, the canopy 13 is extended outwards from the shaft 12. The spring lock is movable within the elongated shaft 12 and is configured to align flush therewith. Thus, the runner 20 can be moved below the spring lock in order to place the canopy 13 in a collapsed configuration.

In other embodiment, the telescopic shaft 12 and canopy 13 are operably connected to an actuator 23 disposed on the handle 14. The actuator 23 is configured to automatically extend the shaft 16 and canopy 13. In one embodiment, the actuator 23 is operably connected to the shaft 12 and the canopy 13 via a spring mechanism. The spring mechanism comprises one or more compressed springs disposed within the umbrella device 11, connecting the rods 15, 16 and plurality of ribs in a collapsed or retracted position to the actuator 23, such that when the actuator is depressed, the compressed spring is released. Once the spring is released, the rods 15, 16 and ribs are allowed to automatically expand and move the shaft 12 and canopy 13 to an open configuration. In other embodiments, the length of the shaft 12 is manually adjusted by applying opposing force on the first and second rods 15, 16.

The umbrella device 11 further comprises one or more fasteners configured to removably secure the device 11 to a surface. In the illustrated embodiment, the fasteners are magnets 19. The magnets 19 are secured to a lower end 24 of each rib 18 in order to removably secure the umbrella device 11 to a magnetic surface, such as between an open vehicle door and the roof of the vehicle, for hands-free use. In the illustrated embodiment, the magnets 19 extend below the lower end 17 of the canopy 13 in order to allow the canopy 13 to rest above the vehicle. In this way, the canopy 13 is unobstructed by a surface by preventing contact therewith. In alternate embodiments, the magnets are electromagnets in order to provide greater magnetic strength and a convenient releasing mechanism for the fasteners. In other embodiments, any suitable fastener can be used in order to allow the umbrella 11 to be supported in a hands-free manner.

Figure 3:
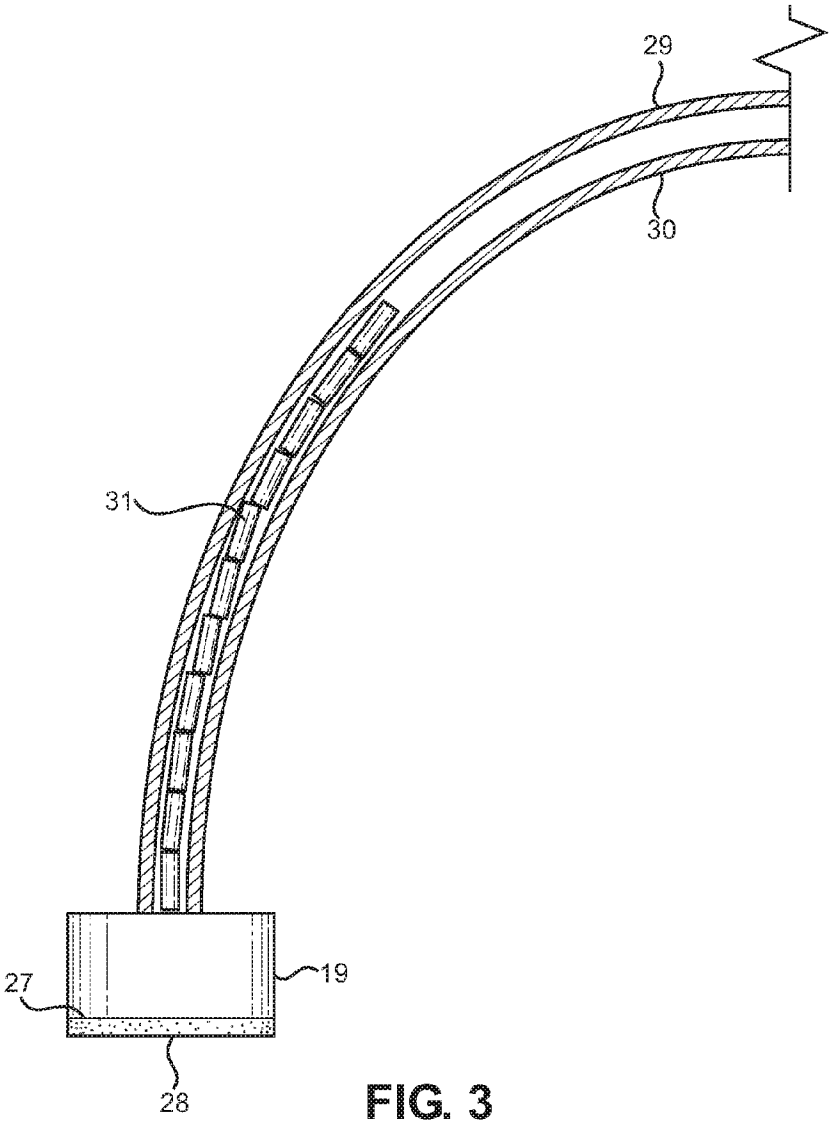
FIG. 3 shows a cross sectional view of a magnet and rib of the umbrella device.

Referring now to FIG. 3, there is shown a cross sectional view of a magnet and rib of the umbrella device. In the illustrated embodiment, the magnets 19 comprise a circular cross section. In some embodiments, one or more pads 28 are disposed on the lower surface 27 of each magnet 19 in order to prevent the magnet 19 from scratching or otherwise damaging a surface on which it is placed. In the illustrated embodiment, the pad 28 extends between the length and width of the lower surface of the magnet 19. In other embodiments, the pad 28 is disposed on the lower surface 27 of the magnet 19 such that pad 28 is adapted to raise the magnet 19 above the surface of a vehicle such that a space is disposed therebetween.

Each rib 18 comprises a first wall 29 and a second wall 30, wherein an interior volume is formed therebetween. The first and second walls 29, 30 are composed of a semi-rigid material, such as aluminum, that is configured to support the canopy of the umbrella in an open configuration. The lower ends of the first and second walls 29, 30 extends upwards from the upper surface of each magnet 18 towards the center of the canopy.

In the illustrated embodiment, one or more weights 31 are disposed within the interior volume of the rib 18, between the first and second walls 29, 30, in order to provide stability to the umbrella 11. The weights 31 serve to prevent the canopy from shifting or becoming detached from a vehicle due to wind or other harsh weather conditions. In the illustrated embodiment, the weights 31 are rectangular in shape and extend between the lower and upper end of the walls. A first side of each weight is positioned flush against the first wall 29 and an opposing second side of each weight is positioned flush against the second wall of the rib 18. The weights 31 are secured to the walls 29, 30 by any suitable fastener, such as adhesive. In alternate embodiments, the weights are any suitable shape, such as cylindrical. In alternate embodiment, the weights are disposed at fixed intervals within the rib 18 in order to provide an even distribution of the weight. In other embodiments, the rib 18 itself is composed of a dense material configured to add weight and stabilize the umbrella device when attached to a vehicle.

Figure 4:
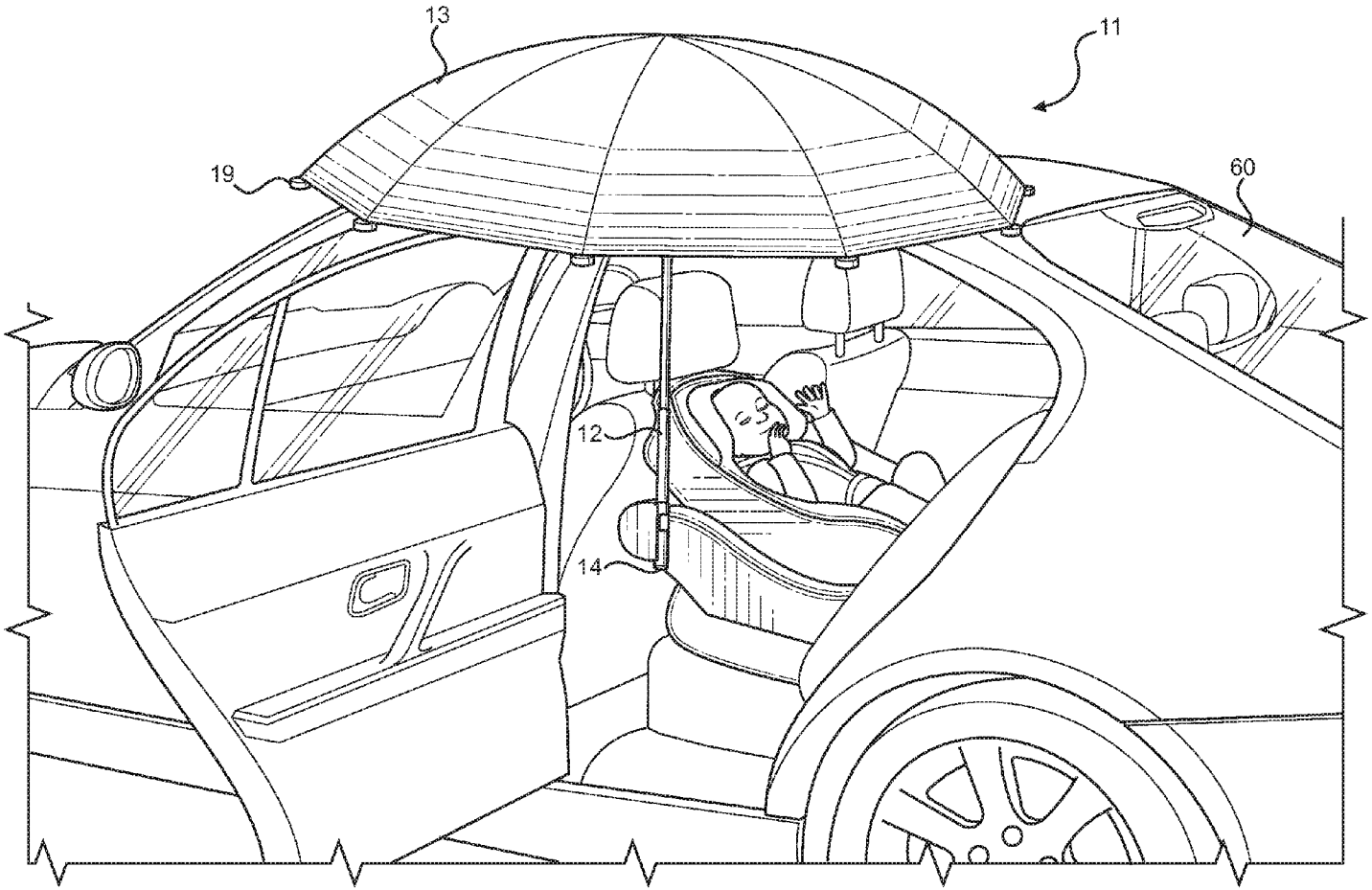
FIG. 4 shows a perspective view of the umbrella device in use.

Referring now to FIG. 4, there is shown a perspective view of an embodiment of the umbrella device in use. In operation, the handle 14 is grasped and the telescopic shaft 12 is extended. The runner is pushed upwards toward the upper end of the shaft 12 so as to extend the canopy to an open configuration. A side of the umbrella device is positioned above the vehicle 60, wherein the magnets 19 are placed on the roof of the vehicle 60. Another side of the umbrella device 11 is positioned over the door of the vehicle 60, wherein magnets 19 extending from the lower end of the canopy 13 are removably secured thereto. Once the umbrellas device 11 removably secured to the vehicle 60, a user may conveniently load or unload items from his or her vehicle 60 while remaining protected by the canopy 13.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An umbrella device, comprising:

a shaft having a first end and a second end, a canopy secured to the second end of the shaft, wherein the canopy is movable between an open configuration and a closed configuration;

a plurality of ribs secured to the canopy, wherein each of the ribs extend between a lower end of the canopy and an upper end of the canopy, wherein the ribs are configured to support the canopy in an open configuration;

one or more fasteners each secured to at least one of the plurality of ribs, the one or more fasteners configured to removably secure at least one of the plurality of ribs to a vehicle surface;

one or more weights secured to a rib;

wherein each of the plurality of ribs comprise a first wall connected to a second wall defining an interior volume therebetween;

wherein the one or more weights are disposed within the interior volume of each of the plurality of ribs.

2. The umbrella device of claim 1, wherein the shaft is telescopic.

3. The umbrella device of claim 1, further comprising a pad disposed on a lower surface of each of the one or more fasteners.

4. The umbrella device of claim 1, further comprising a handle secured to the first end of the shaft.

5. The umbrella device of claim 1, wherein the one or more fasteners are magnets.

6. The umbrella device of claim 1, wherein each of the plurality of fasteners are disposed at a lower end of each of the plurality of ribs, such that the lower end of the canopy is disposed above each fastener.

7. The umbrella device of claim 1, wherein each of the plurality of weights comprise a rectangular cross section.

8. The umbrella device of claim 1, wherein each of the plurality of weights are spaced apart at fixed intervals from one another.

* * * * *